United States Patent [19]

Caldeira

[11] Patent Number: 4,642,914

[45] Date of Patent: Feb. 17, 1987

[54] FASTENING MEANS FOR FOOTWEAR

[75] Inventor: Adelino Caldeira, Bristol County, Mass.

[73] Assignee: Kangaroos U.S.A., Inc., Chesterfield, Mo.

[21] Appl. No.: 707,829

[22] Filed: Mar. 4, 1985

[51] Int. Cl.[4] ..... A43B 11/00; A43B 23/26; A43B 5/00

[52] U.S. Cl. ..... 36/50; 36/54; 36/114; 2/DIG. 6

[58] Field of Search ..... 36/50, 54, 114, 129; 2/DIG. 6; 24/306, 442

[56] References Cited

U.S. PATENT DOCUMENTS

| | | | |
|---|---|---|---|
| 4,126,951 | 11/1978 | Antonious | 36/54 |
| 4,296,558 | 10/1981 | Antonious | 36/50 |
| 4,451,995 | 6/1984 | Antonious | 36/54 X |

OTHER PUBLICATIONS

*Sports Beconta, Inc.*, 1972, Catalog No. 54, 50 Executive Blvd., Elmsford, NY 10523.

*Primary Examiner*—James Kee Chi
*Attorney, Agent, or Firm*—Paul M. Denk

[57] ABSTRACT

A footwear incorporating one or more of straps that cooperate with the upper reinforced edges of the quarter portions for the shoe, so that when the straps are folded over they are tightly held in place by means of fasteners, such as a hook and pile style fastener, or other fastener, or other style of securing means, for locking the shoe into closure. The tongue of the shoe is conveniently and properly positioned through the addition of a loop through which at least one of the straps locate, to assure that all of these upper shoe components are maintained in their proper positioning and alignment not only after the shoe has been fitted, but even during prolonged and sustained usage.

1 Claim, 5 Drawing Figures

FASTENING MEANS FOR FOOTWEAR

BACKGROUND OF THE INVENTION

This invention relates generally to fastening means applied to footwear, and more specifically pertains to the securement of the fastening strap to various component parts of the shoe structure to assure that it remains conveniently and snugly positioned in place upon the foot of the wearer during application of the shoe.

Obviously, there are a variety of fastening means that are used for holding shoes upon the foot of the wearer, and, one of the more contemporary securing means includes the arrangement of one or more straps across the upper space between the quarter portions of the shoe, generally overlying the tongue or gusset provided thereunder, and being secured in place for providing a quick and prompt application of the shoe to the foot of the user. Examples of this type of means for fastening the shoe, and more specifically the sports shoe, can be seen in the U.S. Pat. No. Des. 255,956, to Hirsch. This type of means for shoe fastening is quite effective, makes it much more easier for securement of the shoe upon the foot, and particularly has high utility in the youth field, since the complexities of tying a knot in the usual shoelace can be avoided. But, one of the concerns with utilizing that type of shoe structure, with its shown fastening means, is that the underlying tongue or gusset has a tendency to migrate, whereas, the current invention incorporates a looping member that interlocks with the fastening means, to assure that the shoe, and its gusset portion, are arranged and sustained permanently in their intended positions.

Other patents showing related type of structures include the U.S. Pat. No. 4,282,657, to Antonious, disclosing a heel restraint with an adjustable and flexible closure assembly for shoes. In addition, the patent to Famolare, Jr., U.S. Pat. No. 4,114,297, shows a cinching closure. Furthermore, the patent to Pelfrey, U.S. Pat. No. 4,065,861, shows a football punting shoe, locating an overlying impactor element upon the lacing of the shown shoe. Obviously, strap means upon a shoe have long been available in the art, as is well know, and as can be seen in the patent to Trovato, U.S. Pat. No. 2,925,672. In addition, the patent to Whitman, U.S. Pat. No. 2,539,761, discloses an article of footwear, incorporating various straps. Likewise, the patent to Williams, U.S. Pat. No. 1,763,997, shows a fastener strap for a shoe.

It is, therefore, the principal object of this invention to provide means for fastening into closure an article of footwear, and more specifically an athletic, jogging, or even casual shoe, and more particularly, a fastening means that cooperates with means for locking the fastening means with the tongue or gusset for the identified type of footwear.

Another object of this invention is to provide the locating of hook and pile fastening means, such as the well-known Velcro, onto particular surfaces of a fastening means for a shoe, so as to interlock not only the quarter portions of the shoe into a snug and secure arrangement, but likewise interlock their relationship with the tongue of the shoe bearing its fastening.

Another object of this invention is to provide means for snugly securing footwear onto the foot of the shoe wearer, and provide for its achievement within a minimum of time and with greatly reduced effort.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the formation of a fastening means for an athletic, jogging, or casual shoe, a shoe of the type that incorporates the usual vamp, quarter, counter, and related type of components, that interconnect upon a shoe sole, and in this particular instance, one or more straps are provided along the eyestay or at the upper edges of the quarter portions for the shoe, so that said straps can be folded over into interlocking engagement for securing the shoe into a quick and fascile securement. But, one of the further advantages of this particular invention is the locating of Velcro at strategic locations along these straps, so that not only does the Velcro interlock into a hook and pile type of connector for securement of the shoe into closure, but in addition, provides means for interlocking one or more of these straps with the tongue or gusset portion of the shoe so as to assure that proper alignment and maintenance of the convenient positioning of the shoe components are sustained, even after extended and repeated usage. For example, a loop means is secured in place approximately centrally of the upper surface of the tongue of the shoe, and through which one or more of the straps of this invention may insert, with the loop incorporating also an upper surface containing a fastener, such as one component of Velcro, or perhaps even some form of clasp means, so that as the straps are folded over into closure, they likewise secure to this loop means which interconnects the arrangement of the fastener, and the shoe quarter portions, properly upon and at the convenient snugness upon the interiorly arranged foot, and likewise, fix the positioning of the tongue or gusset for the shoe at that properly aligned location under these straps, and with respect to the upper edges of the quarter portion of the same shoe. In this manner the tongue is conveniently arranged in place, it will not migrate to the sides of the shoe, it provides for a much more secure connection of the shoe upon the foot of the wearer, so as to enhance the utility of the shoe during its lengthy life.

BRIEF DESCRIPTION OF THE DRAWINGS

In referring to the drawing, FIG. 1 provides a plan view of the shoe with fastening means of this invention.

DESCRIPTION OF THE PREFERRED EMBODIMENT

Figure 1:
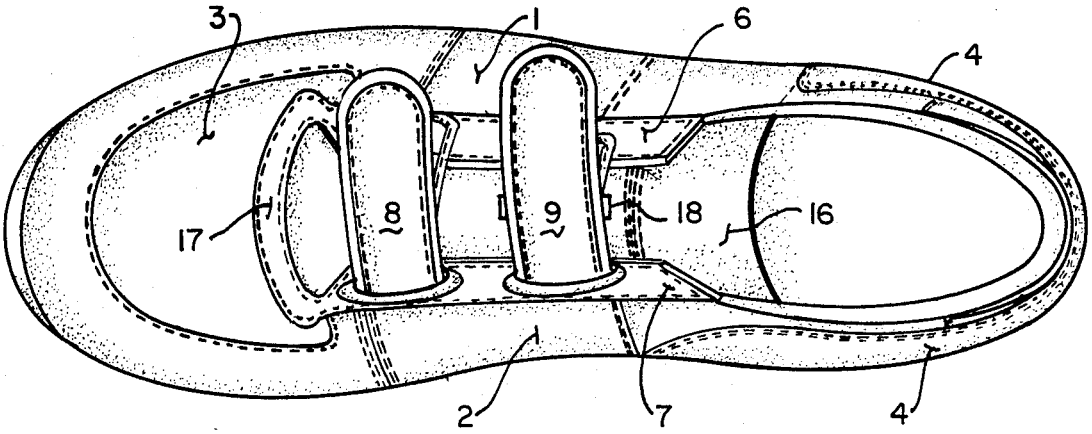
Figure 2:
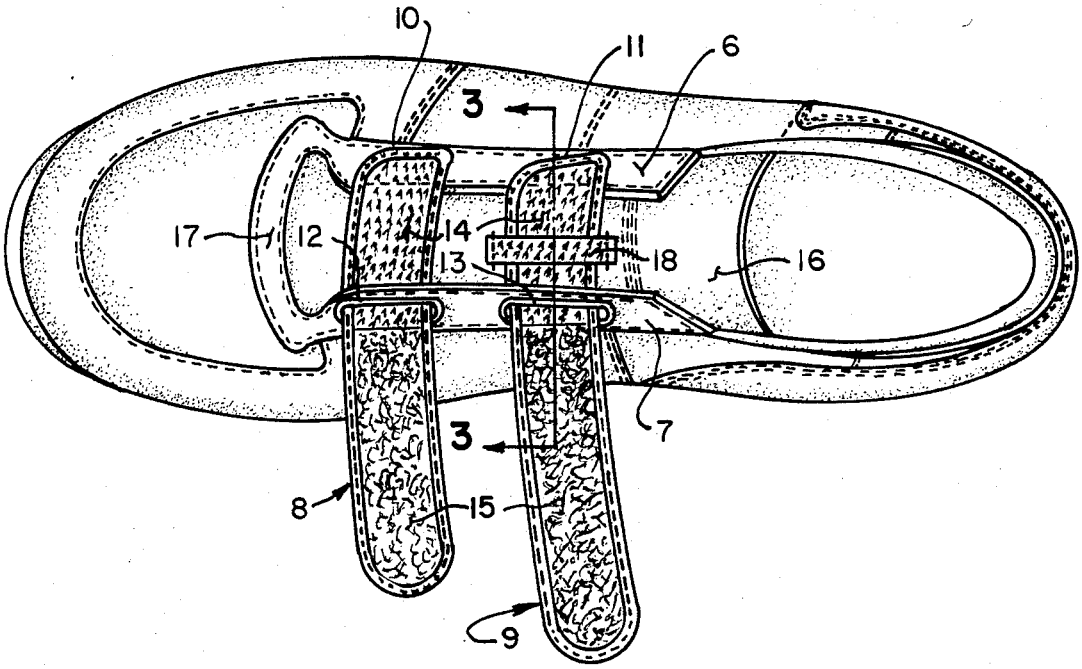
FIG. 2 provides a similar type of plan view to that as shown in FIG. 1, but in this particular instance, the straps are unfolded so as to disclose that relationship of the upper edges of the quarter portions of the shoe, in addition to the inter engagement of the one strap with the loop means of this invention.
Figure 3:
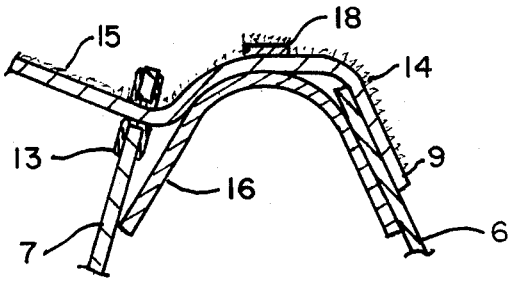
FIG. 3 provides a partial transverse sectional view taken at the line 3—3 of FIG. 2.
Figure 4:
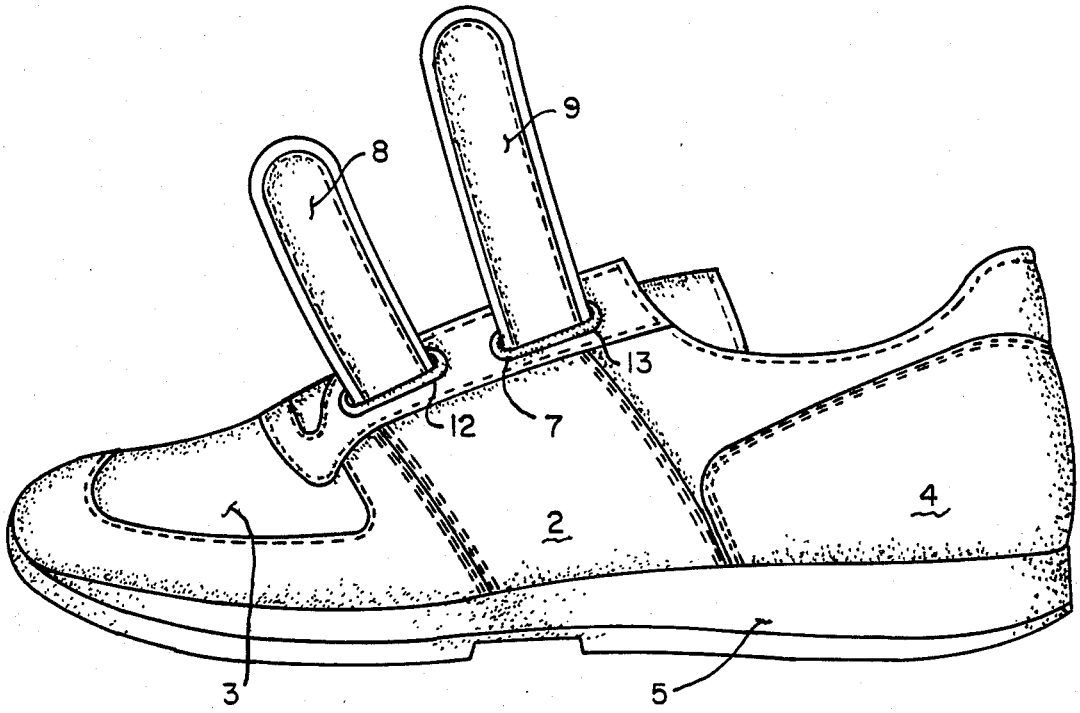
FIG. 4 provides a left side view of the footwear of this invention with its straps in the process of being secured.
Figure 5:
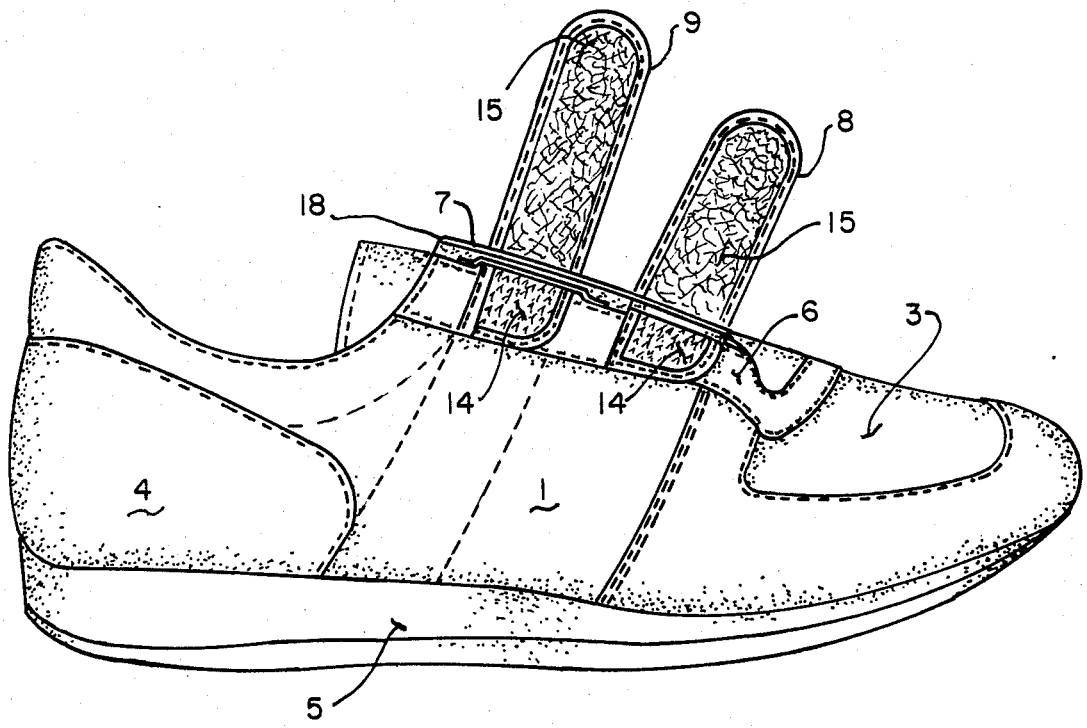
FIG. 5 provides a right side view of the shoe shown in FIG. 4.

Referring to the drawings, and in particular FIGS. 1 and 2, it can be seen that the footwear of this invention, in this particular instance, comprises a shoe of the shape of an athletic or jogging shoe, but this invention obviously can be used just as well with any style of footwear, including the casual shoe. As disclosed, the shoe incorporates the usual quarter portions 1 and 2, integrally connected with the vamp portion 3 of the shoe, in addition to the counter portions 4 and which all integrally connect together for securement with the sole 5 of the shown shoe. (See also FIGS. 4 and 5.) In this particular instance, the footwear is fabricated having upper reinforced edges 6 and 7 provided respectively along the upper edges of the quarter portions 1 and 2, as can be seen. And, fastening means are provided for securement of the shoe snuggly about the foot, and in this particular instance, a pair of strap means 8 and 9 are provided. Each of these strap means are secured by stitching, or by other means, at their ends 10 and 11 to the reinforced upper edge 6 of the quarter portion 1 of the shoe, while the other reinforced upper edge 7 of the opposite quarter portion 2 is provided with a reinforced slot, there being two in number, as at 12 and 13, and which are conveniently aligned with the two straps 8 and 9 to provide for their convenient insertion therethrough, as can be so clearly seen in FIG. 2. Each of these strap means 8 and 9 are formed for the adherence through the use of hook and pile fastening means, such as Velcro, along their upper disposed surfaces, these surfaces being identified with respect to the location of the strap means as so clearly shown in FIG. 2. This hook and pile fastener means, or Velcro, is formed, as is well known, in two segments, one being the hook means portion, as at 14, while the other part of the Velcro comprises the pile portion, as at 15, as can be noted. In addition, and further provided in the construction of this invention includes the usual integrally connecting tongue or gusset portion 16 of the footwear, that is integrally stitched to the shoe usually at its upper vamp portion, as at 17, and in this particular instance, the tongue incorporates at least one loop means 18 which also includes a surface of Velcro, such as the hook component, as can be noted, so that as the, at least in this particular instance, as the strap 9 is tightened, and then folded over into closure, it not only adheres to the hook portion 14 of its respective strap, but likewise, secures to the hook component formed upon the upper surface of this loop means 18, as can be seen. In this manner, not only is the strap conveniently and snugly tightened in place for securing the shoe about the foot of its wearer, but in addition, the strap is conveniently interlocked with the loop means 18, of the tongue 16, to assure that it remains in its proper positioning, as originally fixed, and does not migrate laterally of the shoe or the foot after prolonged usage. Thus, the feature of this invention of providing a more secure interlocking of the shoe components together, as it is fastened in place about the foot of the wearer, can be conveniently attained through the formation of the strap means, in cooperation with the loop means as shown, so as to provide for proper placement and spacement of the upper edges of the quarter portion of the shoe, while the shoe is inserted upon the foot, and maintaining the convenient positioning of the tongue thereunder, through the interlocking relationship formed between the strap 9, at least in the shown instance, and the loop 18, as defined.

It can be noted from the description of this invention that at least one of the strap means cooperates with the loop 18 for fixing the tongue with respect to the upper shoe components, as previously explained. On the other hand, it is just as likely that there may be a loop means 18 associated with each strap, or perhaps one long loop that overlies each strap, and through which they may initially insert, and in addition, it is just as likely that more than a pair of straps can be applied in conjunction with this particular invention. Two straps are shown for the preferred embodiment, but it is just as likely that a single strap, perhaps of wider dimension, or perhaps more than two straps, can be applied with this invention, and provide for this unique interlocking feature between the fastening means, and the loop structure of the shoe gusset, to maintain that proper positioning and alignment of the upper shoe components during footwear usage.

Variations or modifications to the structure of this invention may occur to those skilled in the art upon reviewing the subject matter of this invention. Such variations or modifications, if within the spirit of this invention, are intended to be encompassed within the scope of any claims to patent protection issuing hereon. The description of the preferred embodiment set forth herein is done so for illustrative purposes only.

Having thus described the invention, what is claimed and desired to be secured by Letters Patent is:

1. A fastening means for footwear, such footwear comprising an athletic shoe, said shoe being of the type incorporating a vamp, quarters, counter, and tongue portions, all integrated together with the sole structure, the improvement which comprises, said fastening means cooperating with the approximate upper edges of the quarter portions and when secured holding said footwear into closure, said fastening means including a pair of strap means, said strap means connecting between the said approximate upper edges of the said quarter portions, securing means provided upon said strap means for fastening of said strap means and the footwear into closure, said securing means comprising hook and pile fastener means, said securing means provided upon the upper disposed surface of said strap means, loop means, provided upon the said tongue, and disposed for insertion of one of the strap means therethrough for positioning of said fastening means with respect to the tongue portion of the footwear during closure, said loop means also having securing means provided upon its upper disposed surface, said strap means, at one end, secured to the approximate upper edge of one quarter portion, there being corresponding slots for each strap means formed through the approximate upper edge of the other quarter portion, said strap means respectively inserting through the said loop means and the slots, and each strap means being folded back upon itself and fastening upon the securing means of the underlying strap and loop means, whereby the folding over of the strap means upon itself providing for the engagement by the securing means of one of the strap means by locking onto the securing means provided upon the loop means and the securing means further provided upon said strap means and thereby providing for the permanent aligned positioning of the tonque and the footwear as applied to the foot of its wearer.

* * * * *